US007600342B2

(12) United States Patent
Fiveash

(10) Patent No.: US 7,600,342 B2
(45) Date of Patent: Oct. 13, 2009

(54) TREE STAND WITH FAST-ACTING SCREW ASSEMBLY AND METHOD OF USING SAME

(76) Inventor: Ramon A. Fiveash, 5938 Woodway Place Ct., Houston, TX (US) 77057

( * ) Notice: Subject to any disclaimer, the term of this patent is extended or adjusted under 35 U.S.C. 154(b) by 0 days.

(21) Appl. No.: 11/880,821

(22) Filed: Jul. 24, 2007

(65) Prior Publication Data

US 2008/0040971 A1 Feb. 21, 2008

Related U.S. Application Data

(60) Provisional application No. 60/843,964, filed on Sep. 12, 2006, provisional application No. 60/838,020, filed on Aug. 16, 2006.

(51) Int. Cl.
*A47G 33/12* (2006.01)

(52) U.S. Cl. ..... 47/40.5

(58) Field of Classification Search ..... 47/40.5; D11/130.1; 248/523
See application file for complete search history.

(56) References Cited

U.S. PATENT DOCUMENTS

| | | | | | |
|---|---|---|---|---|---|
| 150,900 | A | | 5/1874 | Silver et al. | |
| 236,239 | A | * | 1/1881 | Morris | 269/181 |
| 294,781 | A | | 3/1884 | Hilts | |
| 854,512 | A | | 5/1907 | Mapes | |
| 1,340,477 | A | | 5/1920 | Dallard | |
| 1,475,907 | A | | 11/1923 | Volman | |
| 1,749,491 | A | | 3/1930 | Kokay | |
| 1,846,422 | A | | 2/1932 | Hands | |
| 2,102,602 | A | | 12/1937 | Nash | |
| 2,156,195 | A | | 4/1939 | Robillard | |
| D125,771 | S | * | 3/1941 | Kiesow | D11/130.1 |
| 2,408,801 | A | | 10/1946 | Miller | |
| 2,461,687 | A | | 2/1949 | Hopfeld | |
| 2,463,263 | A | | 3/1949 | Gordon | |
| 2,546,336 | A | | 3/1951 | Gibbons | |
| 2,636,528 | A | | 4/1953 | Golnick | |
| 2,644,498 | A | | 7/1953 | Malecki | |
| 2,671,482 | A | | 3/1954 | Gordon | |
| 2,705,983 | A | | 4/1955 | Guadagna | |
| 2,947,333 | A | | 8/1960 | Johnson | |
| 3,066,931 | A | | 12/1962 | Beals | |
| 3,193,277 | A | | 7/1965 | Nagamori | |
| 3,599,960 | A | | 8/1971 | Phillips | |
| 4,534,547 | A | | 8/1985 | Cox | |
| 4,569,510 | A | * | 2/1986 | Haramoto | 269/181 |
| 4,582,307 | A | | 4/1986 | Wang | |

(Continued)

*Primary Examiner*—Francis T Palo
(74) *Attorney, Agent, or Firm*—Douglas W. Rommelmann; Andrew Kurth LLP

(57) ABSTRACT

A tree stand assembly including a container defining a basin and a plurality of securement assemblies attached to the container. The securement assemblies are spaced from each other and define a space within the container for receiving the base of a tree trunk. Each securement assembly has a support member having a passageway in an upper portion thereof and a fast-acting screw assembly. Each fast-acting screw assembly includes an engager having a threaded recess portion, and a bolt having a threaded shank designed to threadedly engage the recess portion threads when the bolt extends through the passageway. The engager has a normal or biased condition allowing the bolt to slide in a first axial direction in the passageway while preventing the bolt from sliding in an opposing second axial direction.

26 Claims, 11 Drawing Sheets

U.S. PATENT DOCUMENTS

| | | | | | |
|---|---|---|---|---|---|
| D297,520 | S | * | 9/1988 | Thomas | D11/130.1 |
| D351,570 | S | * | 10/1994 | Fillipp | D11/130.1 |
| 5,568,916 | A | | 10/1996 | Gibbons et al. | |
| 5,707,037 | A | | 1/1998 | Pastrick | |
| 5,743,508 | A | | 4/1998 | Fiveash | |
| 5,850,680 | A | | 12/1998 | Verrier et al. | |
| 5,913,509 | A | | 6/1999 | Price et al. | |
| 5,941,152 | A | | 8/1999 | Kim | |
| 6,098,973 | A | * | 8/2000 | Khachatoorian | 269/182 |
| 6,250,621 | B1 | | 6/2001 | Ping | |
| 6,286,804 | B1 | * | 9/2001 | Avinger et al. | 248/523 |
| 6,419,202 | B1 | | 7/2002 | Thurner | |
| 6,681,519 | B2 | | 1/2004 | Cone | |
| 6,877,274 | B2 | | 4/2005 | Fiveash | |
| 6,993,868 | B2 | | 2/2006 | Hronyetz | |
| 7,044,427 | B2 | | 5/2006 | Eckenswiller | |
| 7,073,755 | B2 | | 7/2006 | Michaud et al. | |
| 2005/0051695 | A1 | | 3/2005 | Kovach | |
| 2006/0186305 | A1 | | 8/2006 | Krinner | |
| 2006/0226332 | A1 | | 10/2006 | Kowalski | |
| 2006/0255231 | A1 | | 11/2006 | Rainford et al. | |
| 2007/0023606 | A1 | | 2/2007 | Zimmermann | |

* cited by examiner

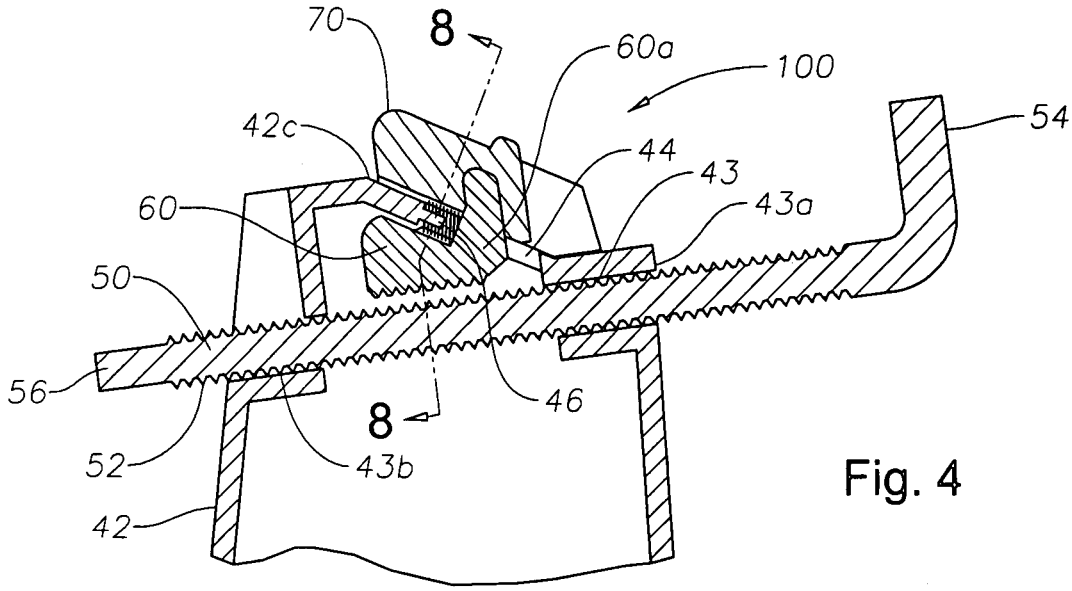
Fig. 4
Fig. 5
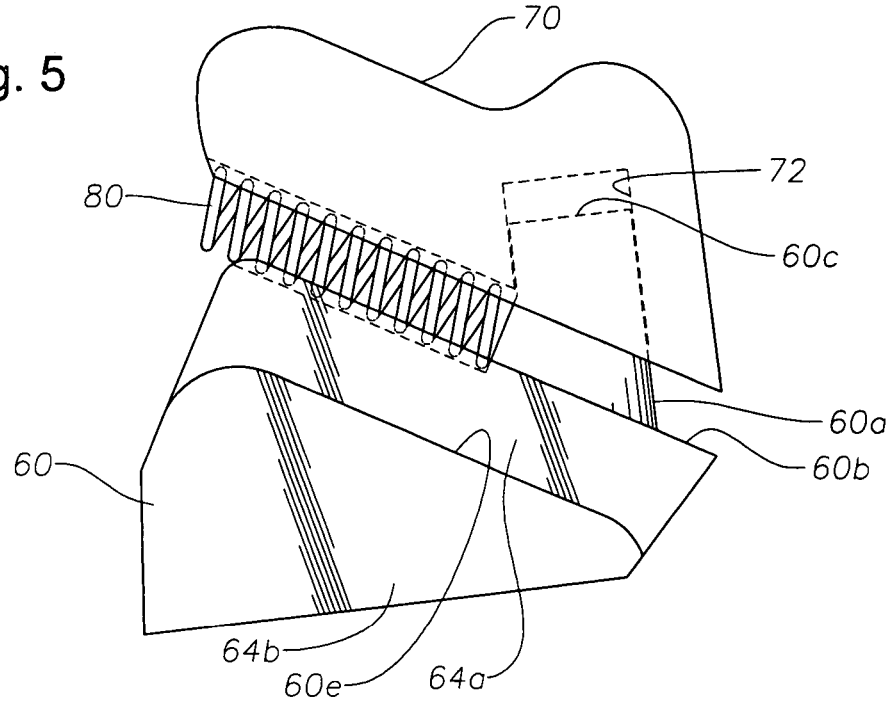

TREE STAND WITH FAST-ACTING SCREW ASSEMBLY AND METHOD OF USING SAME

CROSS-REFERENCE TO RELATED APPLICATIONS

This application claims priority from U.S. Provisional Application Ser. No. 60/838,020, filed Aug. 16, 2006, and also claims priority from U.S. Provisional Application Ser. No. 60/843,964, filed Sep. 12, 2006. Applicant incorporates by reference herein U.S. Provisional Application Ser. Nos. 60/838,020 and 60/843,964 in their entireties.

BACKGROUND OF THE INVENTION

1. Field of the Invention

The present invention relates to stands for trees, such as Christmas trees, and more particularly for tree stands with quick acting screw assemblies and a method of using same.

2. Description of the Related Art

During the Christmas season, it is commonplace for individuals and families, particularly of the Christian faith, to adorn their living spaces and/or work places with one or more trees decorated with various lights and ornaments. Although artificial trees are used by some, a great many people still prefer to decorate a "live" or cut tree. This has been a custom for centuries and will most certainly continue indefinitely.

The Christmas tree, whether artificial or live, requires support to maintain the tree upright and prevent it from tipping over. However, the required support for an artificial tree is simpler than for a live tree. Live trees typically require a stand having a base and a water basin or reservoir for providing water essential for maintaining tree freshness and for preventing the cut tree from becoming a fire hazard. As most everyone is aware, live trees are not uniform and symmetrical in shape. To support the tree against tipping, the base of the stand needs to be broad enough to provide stability when the trunk of the tree is mounted within the water basin. Typically, the stand includes a plurality of threaded screws which are tightened against the tree trunk when the trunk's lower end is positioned in the basin.

It would be advantageous to provide a tree stand which can include a broad and shallow basin which will accommodate a range of tree trunk diameters, has an accessible top for replenishing the water supply, and provides ample lateral support for the tree within the basin.

Applicant's U.S. Pat. No. 5,743,508 for "Tree Stand With Upward/Extending Support Members Forming Part Of A Water Basin," issued Apr. 28, 1998, discloses a tree stand having a large water basin and a plurality of extending support members for supporting the tree. The extending support members form part of the sidewalls of the water basin and include threaded bolts or screws to secure the tree trunk to the extending support members. The spacing of the extending support members allows lower tree limbs to extend between the support members and above the lower sidewall portion of the water basin. The tree is secured to the stand by manually rotating and tightening the threaded bolts.

Applicant's tree stand of the '508 patent has been a huge commercial success.

Nearly everyone who has installed a live Christmas tree in a tree stand knows and appreciates that most trees are not the "perfect" tree. The tree may be lopsided; the trunk may be crooked; the trunk may be non-circular at the base, the trunk may have very low limbs which may need to be pruned, etc. These factors can result in much trial and error in adjusting the threaded bolts to secure the tree in the tree stand in a "plumb," vertical or aesthetically pleasing orientation. The threaded bolts are typically about 5/16" diameter having approximately 16 threads per inch. Proper positioning and adjusting of the bolts typically requires numerous rotations of each and every bolt spaced uniformly around the tree trunk—a somewhat challenging experience, particularly when lying on the floor beneath the Christmas tree.

It is desirable to have a tree stand that reduces the challenges associated with securing the tree to the tree stand. It is further desirable to have a tree stand that can be quickly adjusted to secure the tree in the desired upright orientation. It is desirable that the securement assembly be easy to assemble and operate, dependable, durable, and provides necessary strength axially and laterally. It is also desirable that the tree stand have a low stacking height and a minimum of loose parts for shipping purposes. It is further desirable that the tree stand could optionally incorporate one or more of the tree stand features disclosed in U.S. Pat. No. 5,743,508.

SUMMARY OF THE INVENTION

The preferred embodiment of the present invention is a tree stand that reduces the challenges associated with securing a tree to the tree stand and is quickly adjusted to secure the tree in the desired upright orientation. The tree stand has a securement assembly that is easy to assemble and operate, dependable, durable, and provides necessary strength axially and laterally. The tree stand preferably has a low stacking height and a minimum of loose parts for shipping purposes. The preferred embodiment of the tree stand incorporates many of the tree stand features disclosed in applicant's U.S. Pat. No. 5,743,508.

BRIEF DESCRIPTION OF THE DRAWINGS

A better understanding of the present invention can be obtained when the following detailed description of a preferred embodiment is considered in conjunction with the drawings in which:

FIG. 4 is a partial view of FIG. 3 showing the tree securement assembly in a displaced and disengaged position;

FIG. 5 is a side elevation view of a slide engager, button and spring of a fast-acting screw assembly according to a preferred embodiment of the present invention;

DETAILED DESCRIPTION OF PREFERRED EMBODIMENTS

Figure 1:
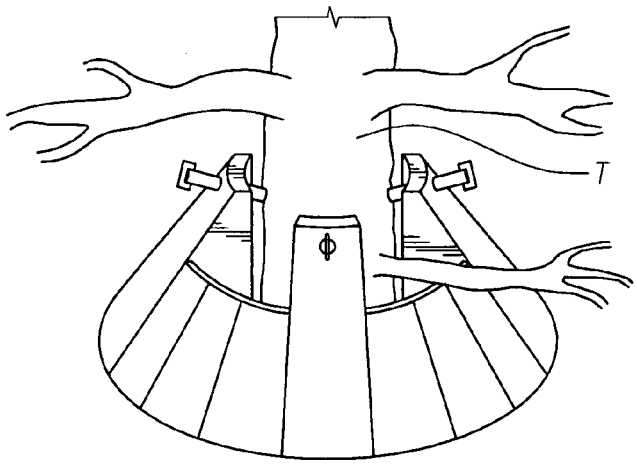
Fig. 1 (Prior Art)
FIG. 1 is a perspective view of applicant's prior art tree stand.

FIG. 1 is generally a tree stand figure from applicant's U.S. Pat. No. 5,743,508.

The present invention incorporates many of the features disclosed in applicant's prior U.S. Pat. Nos. 5,743,508 and 6,877,274. Applicant incorporates by reference herein U.S. Pat. Nos. 5,743,508 and 6,877,274.

Figure 2:
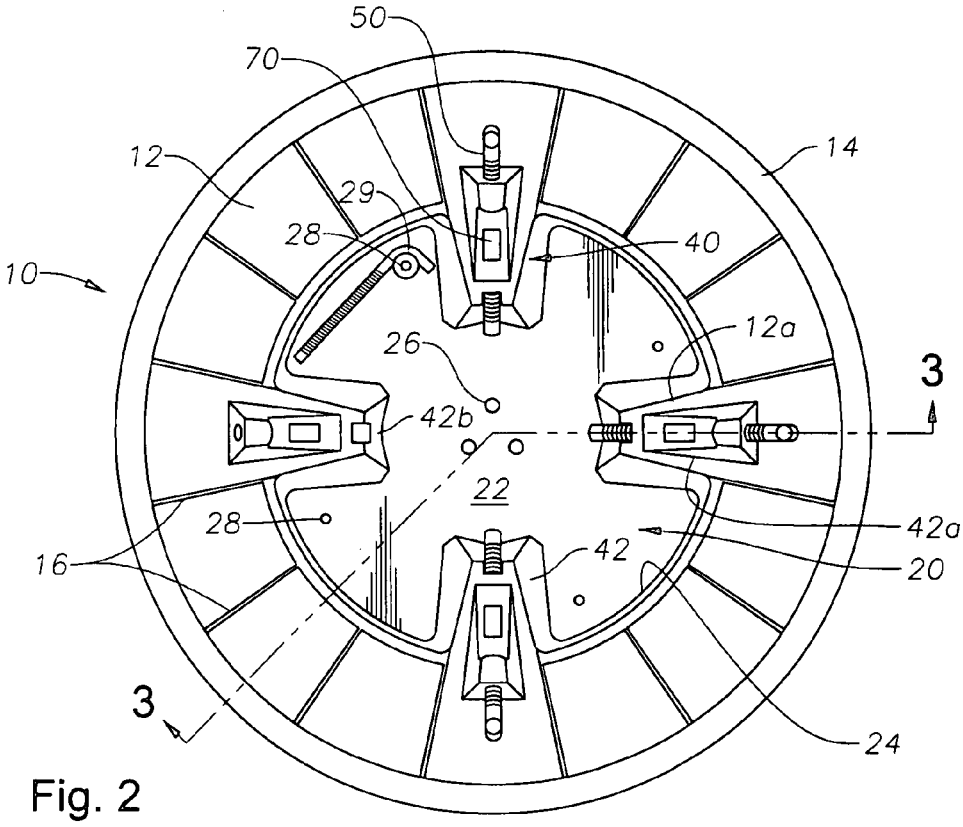
FIG. 2 is a top plan view of a preferred embodiment of the tree stand of the present invention.
Figure 3:
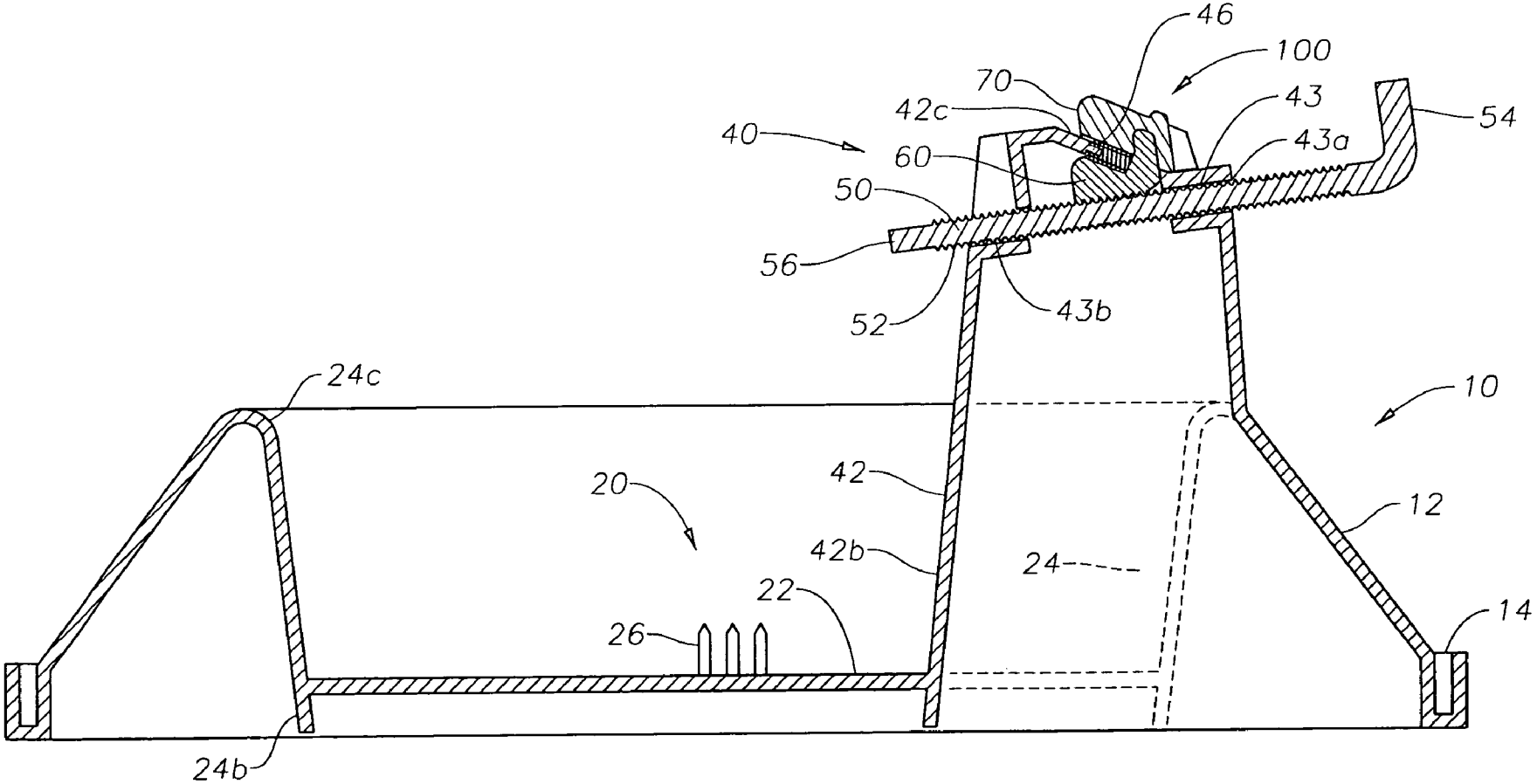
FIG. 3 is a view taken along line 3-3 of FIG. 2 and showing a tree securement assembly according to a preferred embodiment of the present invention in a biased and engaged position.

The tree stand according to a preferred embodiment of the present invention is generally referenced in the drawings as number 10. With reference to FIGS. 2 and 3, the tree stand 10 of the preferred embodiment is generally conical shaped having a sloping exterior wall 12 joining an outer spill guard 14 formed at the outer periphery of the tree stand 10. The spill guard 14 is preferably provided around the stand 10 in the event that water should spill or flow down the exterior wall 12, as for example when adding water to the water basin 20 of the tree stand 10. Preferably, the outer periphery of the tree stand 10 is circular in shape.

Preferably, the water basin 20 of the tree stand 10 is formed from a bottom wall 22 adjoined to a substantially upright basin sidewall 24. As shown in FIGS. 2 and 3, a restraining device 26, preferably one or more upright nails, extends from the bottom wall 22 of the basin 20 for restraining the end of the tree trunk T (FIG. 1) from lateral movement within the stand 10.

Referring to FIG. 3, the basin sidewall 24 has upper and lower ends 24*a* and 24*b*, respectively. The upper end 24*a* of the basin sidewall 24 preferably joins the upper portion of the sloping exterior wall 12. The basin sidewall lower end 24*b* and the lower surface of the bottom wall 22 are preferably slightly elevated relative to the lower surface of the spill guard 14 which rests on the floor. This is preferably accomplished through strengthening ribs 16 which reinforce the sloping exterior wall 12 to the basin sidewall 24 and to the spill guard 14. Thus, the weight of the Christmas tree is preferably supported by the floor through the spill guard 14. It has been found that an outer diameter of approximately twenty inches is suitable for supporting trees having a height in the range of approximately six to eight feet. In a preferred embodiment, the diameter of the spill guard 14 is approximately twenty inches.

It has been found that elevating the basin bottom wall 22 relative to the floor minimizes the risk that condensation resulting from the difference between the air temperature and the temperature of the water in the basin 20 will cause the underlying floor to become moist. An elevation of ½" to 1" is adequate for this purpose. As can be appreciated, distributing the weight of the tree around the large outer spill guard 14 increases the stability of the tree stand 10.

Preferably, a plurality of tree securement assemblies 40 are connected, joined or integrally formed with the sloping exterior wall 12 and/or the water basin 20. Preferably, three or four tree securement assemblies are desirable to secure a tree trunk T (FIG. 1) to the stand 10. Although the illustrated embodiments include four equally spaced securement assemblies 40, the number of securement assemblies 40 can be varied based on various design criteria, such as the tree height the stand 10 is designed to accommodate.

In the preferred embodiments of the invention as shown in the figures, each securement assembly 40 includes an upright support member 42 joined at its lower end to the bottom wall 22 and has an upper end extending above the height of the water basin 20 as shown in FIG. 3. In the preferred embodiment, the upright support member 42 is integrally formed with the basin sidewall 24 and the sloping exterior wall 12. As shown in FIG. 2, the support member 42 joins arcuate segments of the basin sidewall 24 and is preferably inboard of the basin sidewall segments. Preferably, the support member 42 is larger in cross-section at its lower end adjacent the bottom wall 22 and tapers inwardly towards its upper end. Preferably, the sloping exterior wall 12 includes an extension portion 12*a* extending above the basin sidewall 24 and forming an exterior support portion 42*a* of the support member 42.

In the preferred embodiment, a centrally-facing surface 42*b* of the support member 42 is arcuate, preferably having a radius lying on a circle common to all of the centrally-facing surfaces 42*b* of the spaced support members 42. Such an arrangement provides greater flexibility to maneuver the tree trunk T within the basin 20 as will be described below. In a twenty inch diameter stand 10 having four equally spaced securement assemblies 40, the centrally-facing surfaces 42*b* near the bottom wall 22 may lie on a 3" radius circle to accommodate trees having a trunk diameter up to approximately 6". Additionally, each centrally-facing surface 42*b* can have a 2" arc length which provides ample space along the 3" radius circle to position irregular trunk cross-sections, bumps, or low tree limbs (see FIG. 1) between the spaced upright support members 42. It is to be understood that the spacing between adjacent tapered upright support members 42 increases from the bottom wall 22 towards the upper end of the support member 42 as illustrated in FIG. 2.

With reference to FIGS. 3-6, a bolt 50, a slide engager 60, a button 70 and a spring 80 of a preferred embodiment of a fast-acting screw assembly 100 is depicted. FIG. 3 illustrates a preferred embodiment of the tree stand 10 with the tree securement assembly 40 in a biased and engaged position and FIG. 4 shows the tree securement assembly 40 in a displaced and disengaged position.

A more detailed discussion of the fast-acting screw assembly 100 of the tree securement assembly 40 follows. The bolt 50 is preferably a threaded fastener having a threaded shank 52 and a handle portion 54 to facilitate rotation of the threaded shank 52. The bolt 50 has an inner end 56 adapted to engage the tree trunk T. Alternatively, the inner end 56 may be adapted to receive an end cap 58 (FIGS. 12, 13 and 16) having an enlarged face for engaging the tree trunk T. Preferably, the bolt 50 has 10 to 16 threads per inch.

As shown in FIGS. 3 and 4, the upright support member 42 includes a passageway 43 adapted to receive the bolt 50. Preferably, the passageway 43 is comprised of an outer circular bore portion 43*a* which opens in the underneath side of the support member 42 before aligning with a semi-circular inner portion 43*b*. In the preferred embodiment, the outer circular bore portion 43*a* is axially aligned with the semi-circular inner portion 43*b* and the passageway 43 has a downward angle of approximately 7.5° towards the center of the tree stand 10. Preferably, the portions 43*a* and 43*b* have a length arranged and designed to provide axial orientation and minimize lateral "walking" of the bolt 50 as it securely engages the tree trunk T.

Figure 6:
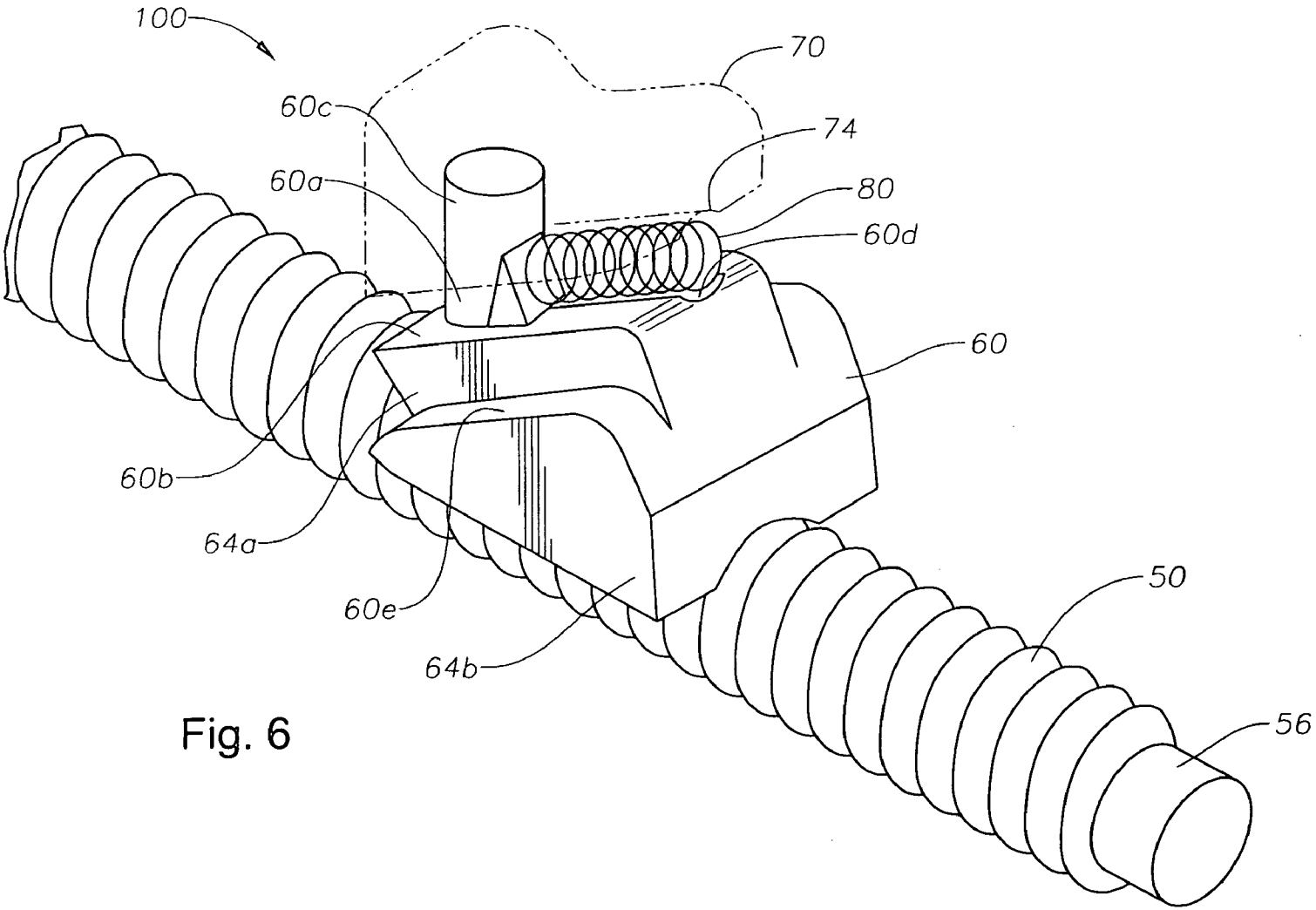
FIG. 6 is a perspective view of a bolt with the fast-acting screw assembly of FIG. 5, the button being shown as transparent in dashed lines for purposes of clarity.
Figure 8:
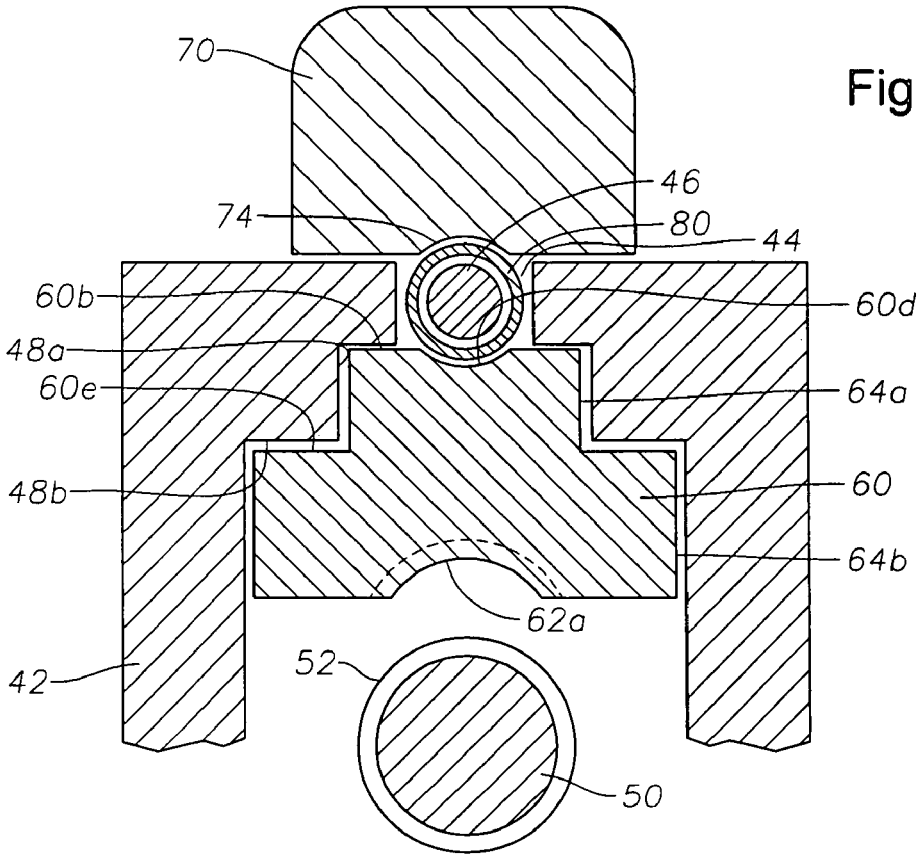
FIG. 8 is a view taken along line 8-8 of FIG. 4.

As shown in FIGS. 4 and 8, the support member 42 includes a slot 44, preferably an elongated slot, through the upper portion of the support member 42. The slot 44 is preferably in a sloped upper surface 42*c* of the support member 42. The slot 44 has a width adapted to receive a slide stub 60*a* of the slide engager 60. As shown in FIGS. 5 and 6, the slide stub 60*a* extends upwardly from a first ramp surface 60*b*. Preferably, the slide stub 60*a* includes an upper end 60*c* adapted to be secured, such as press fit, into a socket 72 of the button 70 as shown in FIG. 5.

Referring to FIGS. 6 and 8, the first ramp surface 60*b* preferably includes a ramp channel 60*d*, preferably arcuate in cross-section, adapted to receive a portion of the spring 80. Preferably, the button 70 also includes a button channel 74, preferably arcuate in cross-section, adapted to receive a portion of the spring 80. The button 70 has been shown as transparent in FIG. 6 for purposes of illustration. Preferably, the slide stub 60*a* forms a spring stop at one end of the ramp channel 60*d*. In a preferred embodiment, one end of the slot 44 includes a post 46 extending along the axis of the elongated slot 44 as shown in FIGS. 3 and 4. The spring 80 is adapted to fit onto the post 46 within the elongated slot 44 as will be explained in greater detail below.

Figure 7:
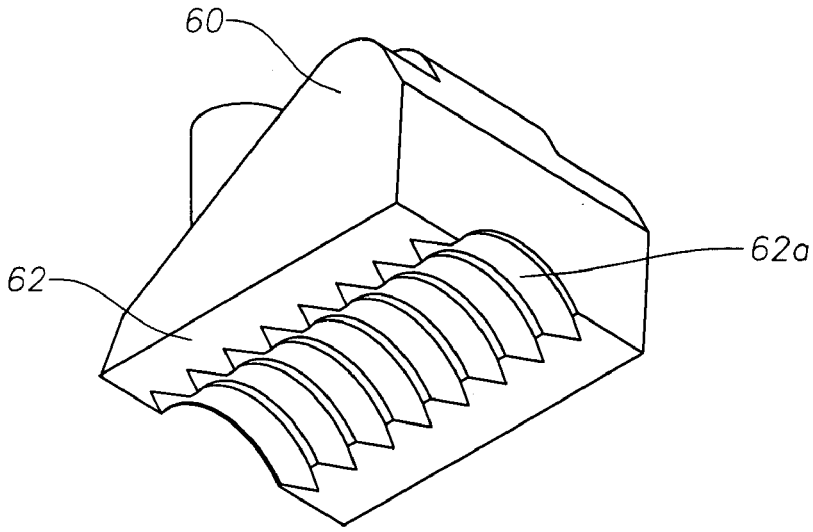
FIG. 7 is perspective view of the slide engager of the fast-acting screw assembly of FIG. 5.

Referring to FIG. 7, the slide engager 60 includes a lower face 62 having a threaded recess 62*a*, preferably extending along the axial length of slide engager lower face 62. The threads of the threaded recess 62*a* and the bolt 50 are mating threads. As shown in FIGS. 7 and 8, the threaded recess 62*a* is preferably less than 180° in circumference, and more preferably approximately 120° in circumference.

Referring to FIGS. 5 and 6, the slide engager 60 preferably includes a second ramp surface 60*e*. The second ramp surface 60*e* is preferably parallel to, lower than, and to the outer sides of the first ramp surface 60*b*. Preferably, a pair of first transverse walls 64*a* separate the first ramp surface 60*b* from the second ramp surface 60*e*, and a pair of second transverse walls 64*b* define the axial sides of the slide engager 60.

The assembly of the preferred embodiment of the fast-acting screw assembly 100 as depicted in FIGS. 2-8 will now be described. The fast-acting screw assembly 100 is assembled to the upright support member 42 by installing the slide engager 60 in the interior of the upright support member 42 from the open lower end of the upright support member 42 (see FIG. 3). The slide engager stub 60*a* is inserted in the support member slot 44 and the slide engager first ramp surface 60*b* and first transverse walls 64*a* are preferably slidably received in a first slide guide 48*a* (FIG. 8) of the support member 42. Additionally, the second ramp surface 60*e* and second transverse walls 64*b* are preferably slidably received in a second slide guide 48*b* (FIG. 8) of the support member 42. The cooperating sliding surfaces ensure that the slide engager 60 remains radially aligned at all times.

With the slide engager 60 positioned in the slide guides 48*a* and 48*b*, a first end of the spring 80 may be slid onto the post 46 in the slot 44 with the second end of the spring 80 abutting the slide stub 60*a*. The button 70 is attached to the slide engager 60 from the upper side of the upright support member 42 by forcibly pressing the slide stub 60*a* extending through the elongated slot 44 into the button socket 72. The spring 80 is thus substantially circumferentially surrounded by the walls of the elongated slot 44, the ramp channel 60*d* and the button channel 74 as shown in FIG. 8. It is to be understood that the spring 80 is maintained in slight compression to exert a spring force against the slide stub 60*a* to force the slide engager 60 down the sloped upper surface 42*c* to a biased position as shown in FIG. 3. In the biased position, the threaded recess 62*a* of the slide engager lower face 62 is axially aligned with the outer bore portion 43*a* and the semi-circular inner portion 43*b* of the bolt passageway 43 for threaded engagement with the bolt 50 upon insertion of the bolt 50 into the passageway 43.

The bolt 50 is installed by inserting the inner end 56 into the outer circular bore portion 43*a* and through the bolt passageway 43. As the bolt 50 is axially inserted in the passageway 43 toward the center of the tree stand 10, the bolt threads 52 come into contact with the threaded recess 62*a* of the slide engager 60 when the slide engager 60 is in the biased position. Preferably, the axial force exerted on the bolt 50 exceeds the spring-bias acting on the slide engager 60 and causes the slide engager 60 to move slightly up the sloped upper surface 42*c*, further compressing the spring 80. Preferably, the amount of centrally-directed, axial force on the bolt 50 required to overcome the spring bias is insubstantial. The position of the slide engager 60 during this sliding insertion of the bolt 50 along the threaded recess 62*a* is referred to as the biased and disengaged position as the bolt threads 52 are not threadedly engaged with the threaded recess 62*a*. Upon removal of the axial force, the threaded portions of the bolt 50 and the slide engager 60 will be permitted to engage each other as a result of the spring bias. This position is referred to as the biased and engaged position.

It is to be understood that the fast-acting screw assembly 100 permits the bolt 50 to be rapidly advanced in the passageway 43 toward the center of the tree stand 10 without rotating the bolt 50. When the axial force is removed, the spring force pushes the slide engager 60 down the sloped upper surface 42*c* to the engaged position in which the threaded shank 52 threadedly mates with the threaded recess 62*a* of the slide engager 60.

Additionally, it is to be understood that the bolt 50 can be freely inserted in the passageway 43 by manually sliding the button 70 up along the sloped upper surface 42*c* (towards the center of the tree stand 10) to a displaced and disengaged position. In the displaced and disengaged position, the slide engager threaded recess 62*a* is displaced and does not contact the threaded shank 52 as the bolt extends through the passageway 43. It is to be further understood that in the displaced and disengaged position the bolt 50 can be slid axially within the passageway 43 in either direction.

Preferably, the slide engager 60 of the fast-acting screw assembly 100 is spring-biased to the biased and engaged position. As described above, an axial force acting on the bolt 50 from the handle portion 54 towards the inner end 56 will overcome the spring force and disengage the mating threads and allow the bolt 50 to travel towards the center of the tree stand 10. However, an axial force acting on the bolt 50 in the opposite direction (i.e., from the inner end 56 towards the handle portion 54) in the biased position causes the wedge-like shape of the slide engager 60 to be wedged more tightly between the bolt 50 and the sloped upper surface 42 of the upright support member 42. Thus, the threaded portions 52 and 62*a* remain firmly mated and the bolt 50 is prevented from moving in an outward direction (i.e., away from the center of the tree stand 10)—unless the bolt 50 is rotated. It is to be understood that in the biased and engaged position, the bolt 50 can move axially in the passageway 43 in either direction by rotation.

During the procedure of placing and securing a tree in the tree stand 10, the bolts 50 are preferably initially retracted such that each bolt inner end 56 is adjacent the respective upright support member 42. The cut end of the tree trunk is positioned, preferably fairly centrally, within the water basin 20. The tree is mounted to the tree stand 10 by placing any interfering lower tree limbs between the upright support members 42, if necessary, and the restraining device 26 is then embedded within the trunk end. The bolts 50 are pushed inwardly until the inner ends 56 contact or are adjacent to the tree trunk T. With the tree in its desired upright position, final tightening of the bolts 50 is accomplished by rotating the bolts 50, preferably no more than one or two revolutions. Each bolt 50 should be rotated at least a quarter turn to a half turn to ensure a secure friction fit between the mating threaded components. When the bolts 50 are tightened securely against the tree, the button 70 and slide engager 60 are prevented from being moved to the disengaged positions—i.e., displaced and disengaged position and biased and disengaged position—because of the threaded frictional engagement of the bolt 50 and the slide engager 60 and the wedge action described above.

To remove the secured tree from the tree stand 10, at least one of the bolts 50 is rotated in the direction to loosen, typically counter-clockwise rotation, to relieve the wedging action caused by the axial force on the bolt 50 and permit the button 70 to be manually slid to the displaced and disengaged position at which time the bolt 50 is free to slid within the passageway 43. Preferably, the button 70 is free to be manually slid to the displaced and disengaged position after loosening the bolt 50 one revolution or less.

In the preferred embodiment, a plurality of pins 28 extend upright from the bottom wall 22 as shown in FIG. 2. Preferably, the pins 28 are formed during the molding of the tree stand 10. The location of the pins 28 is preferably outside the circle formed by the centrally-facing surfaces 42*b* of the upright support members 42 so as not to interfere with the tree trunk T upon installation. Preferably, the pins 28 secure the bolts 50 to the basin bottom wall 22 during shipping. As shown in FIG. 2, the bolts 50 preferably lie flat on the bottom wall 22 and the pins 28 frictionally maintain the bolts in this position during shipping, or alternatively, a pin cap 29 may be positioned on the pin end to secure the bolt 50. To release the bolts 50 from the shipped position, each bolt 50 is manually moved or pried, preferably by raising the inner end 56 of the bolt 50.

Preferably, the tree stand 10 is suitable for closely nesting several stands 10 together—one on top of the other—by reason of having the tree securement assembly 40 made with openings in the bottom of the tree stand T.

In the preferred embodiment, the upright support members 42 together with the inner surfaces of the upright sidewall 24 and the bottom wall 22 define the water basin 20, and the support point for each bolt 50 at the upright support member 42 is located in proximity to the tree trunk T and close to the center of the stand 10. When the bolts 50 are tightened, particularly on rough or irregularly shaped tree trunks, the bolts 50 tend to shift to the side and create lateral and other stresses on the bolts 50, which is minimized when the bolts 50 are supported closer to the tree.

Injection molded plastic is an ideal material for the container of the present invention. Due to the weight of a typical tree, a high impact plastic such as polyethylene or polypropylene is preferred. The plastic material (1) enables the stand 10 to be injection molded, (2) provides a rustproof structure, and (3) provides sufficient resilience to enhance distribution of uneven loads caused by unbalanced trees.

An alternate embodiment of the tree stand, referred to as 10' is shown in FIGS. 9-16. It is to be understood that tree stands 10 and 10' are similar with the primary differences pertaining to the fast-acting screw assembly 100' and the restraining device 26'. Thus, the following discussion will be primarily directed to these features.

Figure 9:
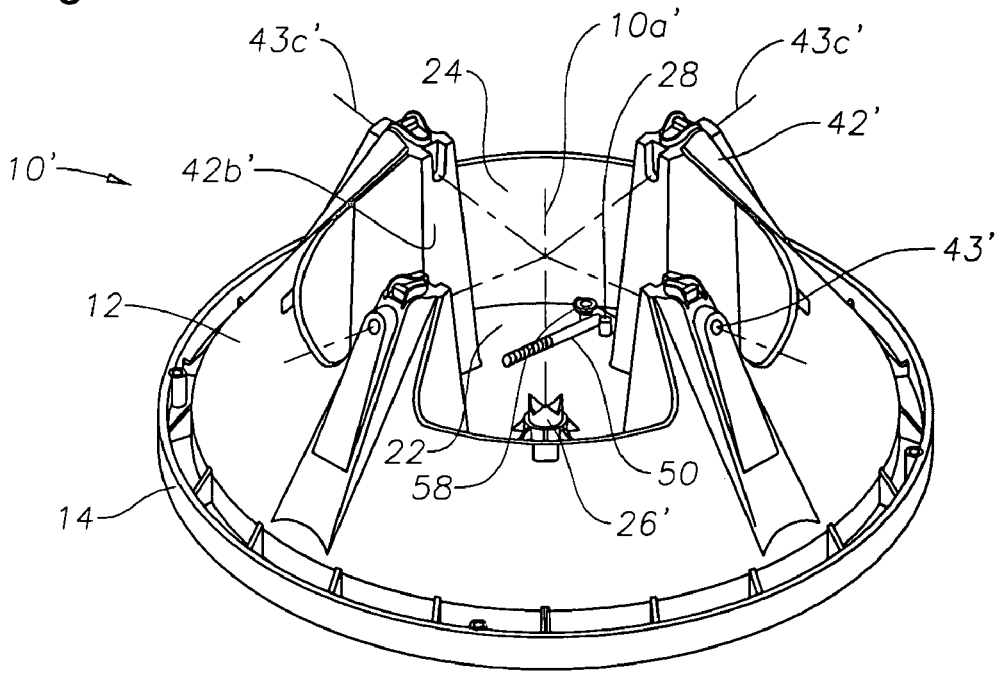
FIG. 9 is a perspective view of a second preferred embodiment of the tree stand of the present invention, the tree stand shown with the bolts in a stored position for shipping.
Figure 10:
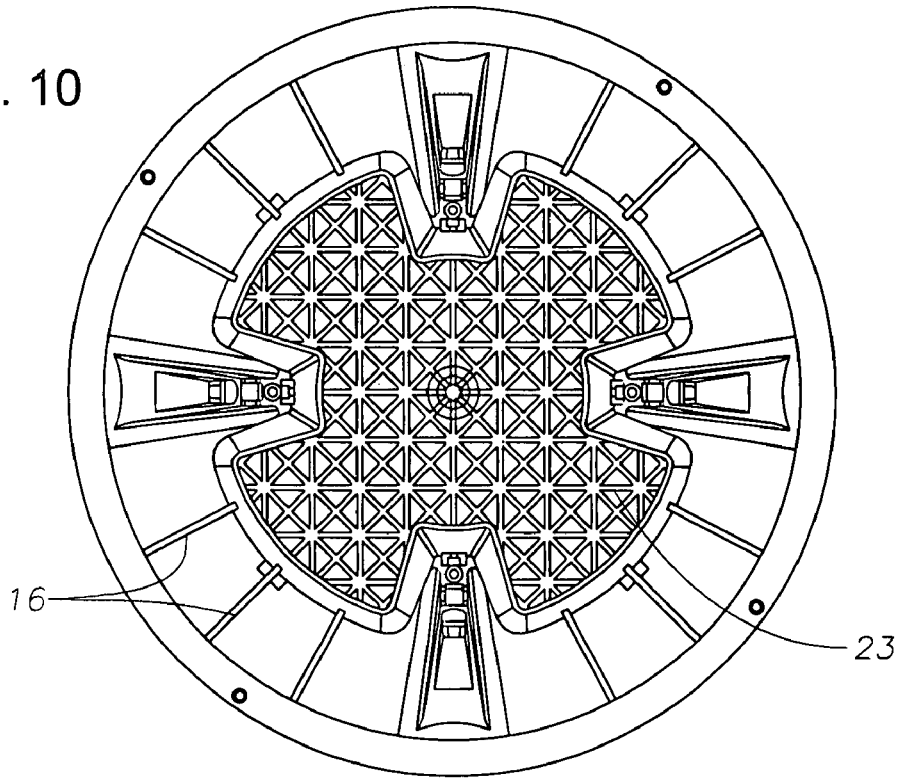
FIG. 10 is a bottom view of the tree stand of FIG. 9.

FIG. 10 is a bottom view of the tree stand 10' of FIG. 9. As shown in the bottom or underside view of FIG. 10, the bottom wall 22 of the basin 20 preferably comprises a lattice-type arrangement 23 for increased strength and rigidity to withstand the forces imposed on the stand 10' by the tree. A plurality of ribs 16 are preferably provided to strengthen and reinforce the exterior wall 12, the spill guard 14 and the basin sidewall 20. It is to be understood that the same or similar reinforcing may also be used with tree stand 10.

Figure 11:
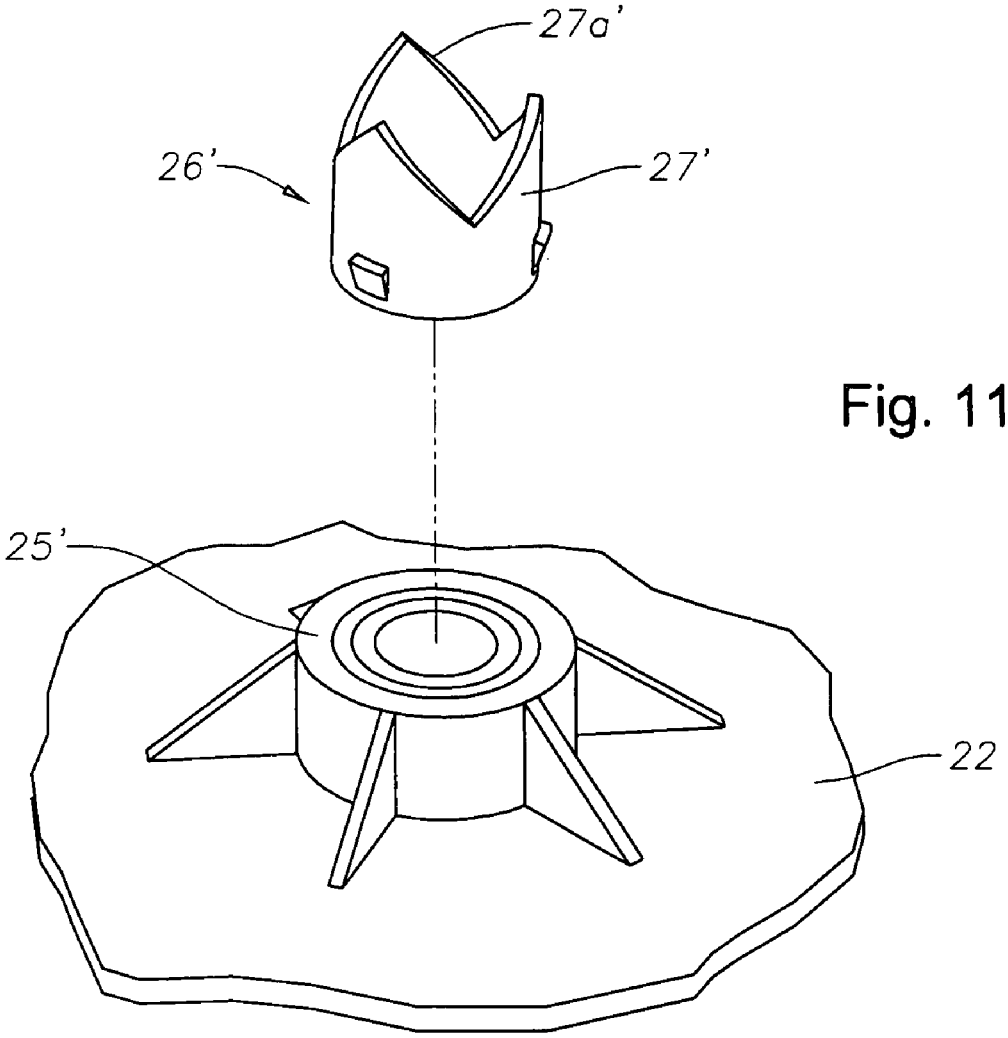
FIG. 11 is an exploded view of a restraining device and a portion of the tree stand base according to a preferred embodiment of the present invention.
Figure 16:
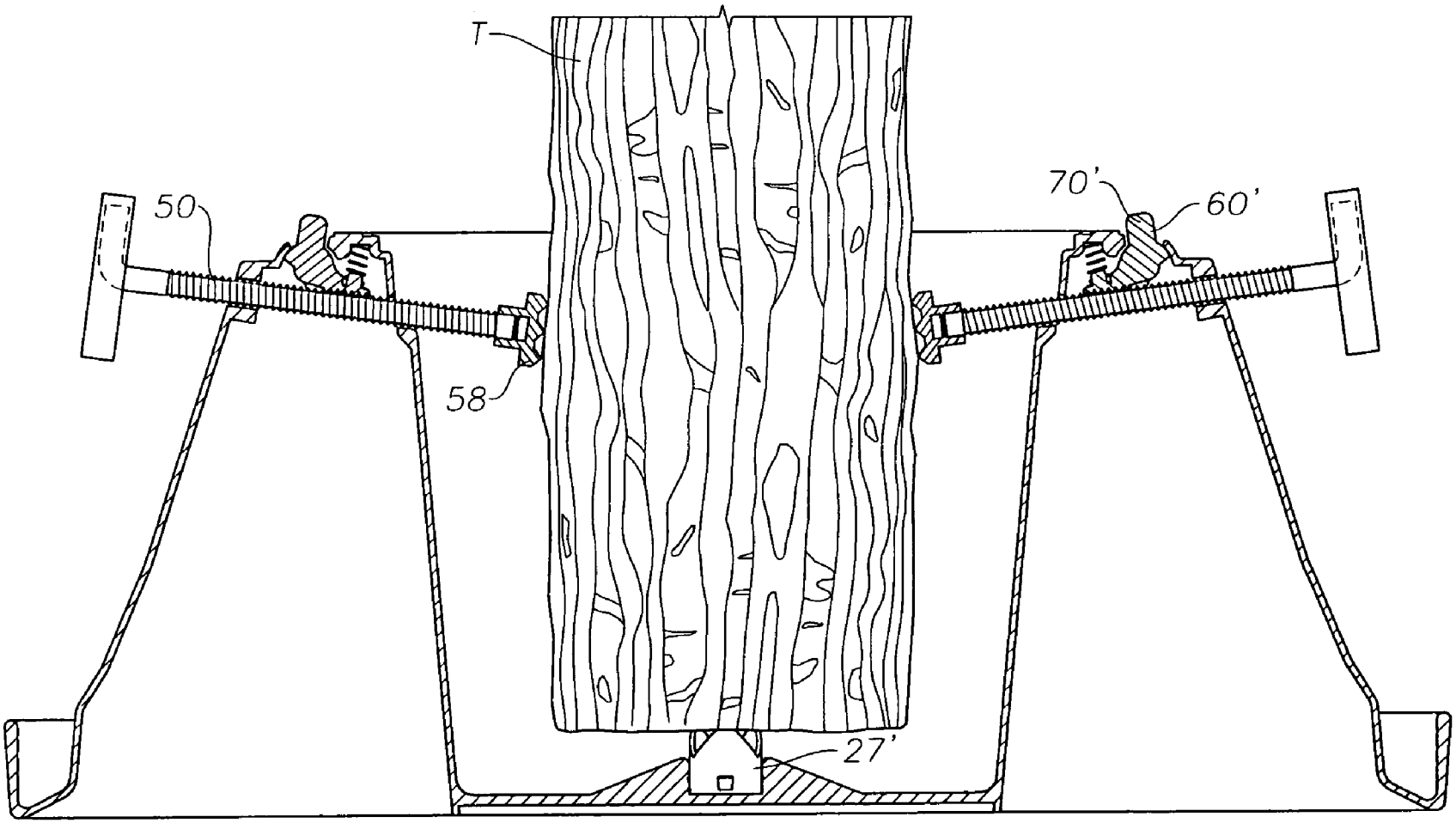
FIG. 16 is a cross-sectional view of the tree stand according to the preferred embodiment shown in FIGS. 9-14.

The restraining device 26' will be described with reference to FIGS. 9, 11 and 16. Referring to FIG. 11, the restraining device 26' preferably includes a trunk crown 27' arranged and designed to be forcibly received within a receptacle 25' connected or attached to, or formed integrally with the basin bottom wall 22. The trunk crown 27' preferably includes a pointed end 27*a'* arranged and designed to engage the lower end of the tree trunk T as shown in FIG. 16. The crown 27' is preferably made out of metal and press fit into the receptacle 25' during the manufacturing process.

The fast-acting screw assembly 100' will now be described with reference to FIGS. 9-10 and 12-16. The fast-acting screw assembly 100' comprises a bolt 50, a pivotal engager 60' and a spring 80'. The pivotal engager 60' is preferably of unitary construction.

As discussed above, the bolt 50 preferably has an inner end adapted to receive an end cap 58 (FIGS. 12, 13 and 16) having an enlarged face for engaging the tree trunk T as shown in FIG. 16.

Figure 12:
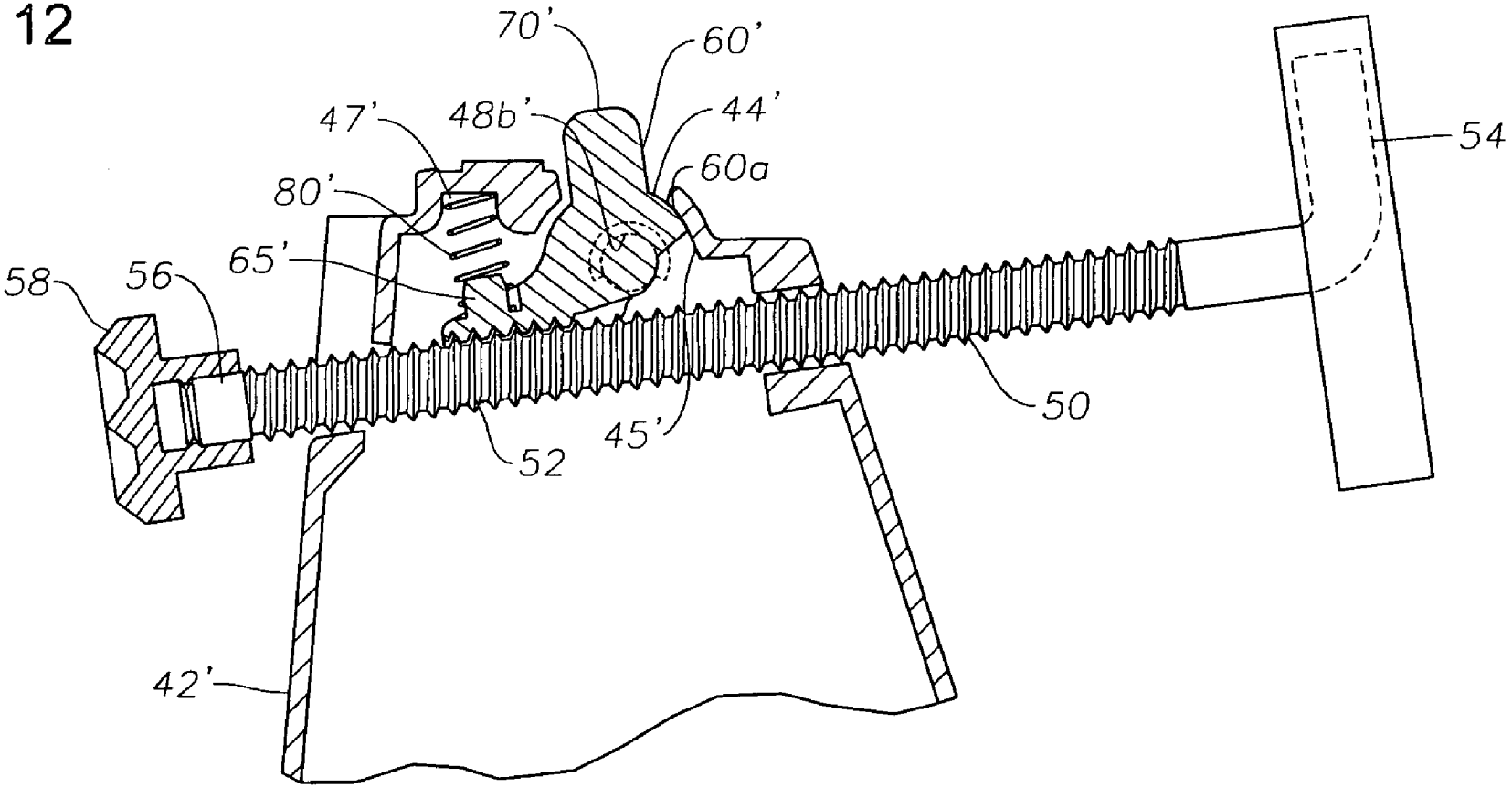
FIGS. 12 and 13 are partial elevation views of the tree securement assembly according to a preferred embodiment of the present invention, the tree securement assembly shown with a pivotal engager engaging the bolt in a biased and engaged position in FIG. 12 and in a biased and disengaged position in FIG. 13.
Figure 13:
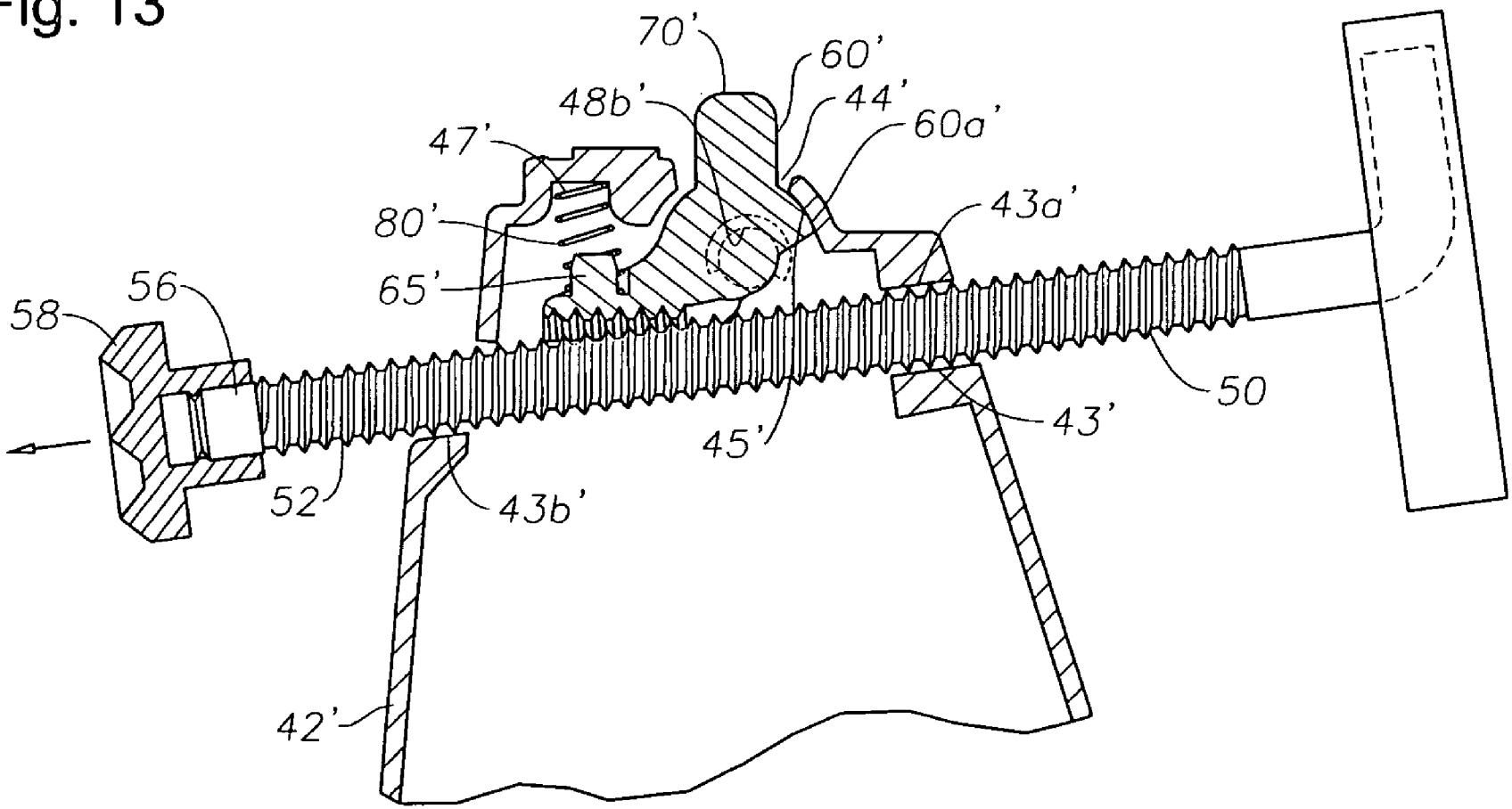

Referring to FIGS. 12 and 13, each upright support member 42' includes a passageway 43' adapted to receive the bolt 50. Preferably, the passageway 43' is comprised of an outer circular bore portion 43*a'* which opens in the underneath side of the support member 42' before aligning with a semi-circular inner portion 43*b'*. In the preferred embodiment, the outer circular bore portion 43*a'* is axially aligned with the semi-circular inner portion 43*b'* and the passageway 43' has a downward angle of approximately 7.5° towards the center of the tree stand 10'.

Figure 15:
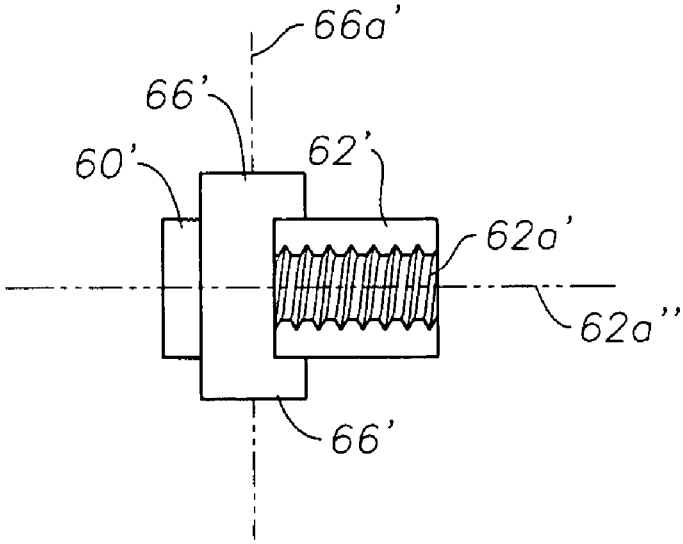
FIG. 15 is a bottom view of the pivotal engager of FIG. 14.

Preferably, the pivotal engager 60' has a lower face 62' including a threaded recess 62*a'*, preferably extending axially along the length of the lower face 62' as shown in FIG. 15. The threads of the threaded recess 62*a'* and the bolt 50 are mating threads. As in the prior embodiment, the threaded recess 62*a'* is preferably less than 180° in circumference, and more preferably approximately 120° in circumference.

Figure 14:
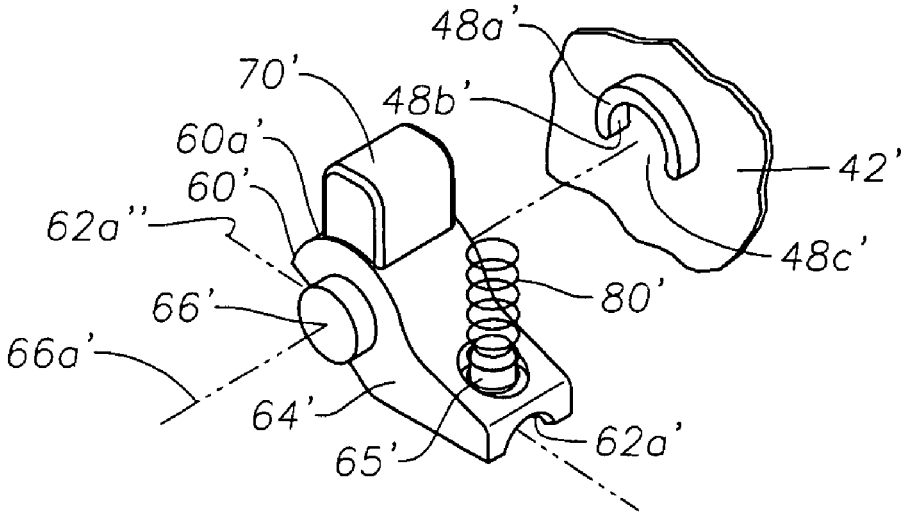
FIG. 14 is an exploded view showing the engagement of an axle of the pivotal engager with a support member.

Referring to FIGS. 14 and 15, the pivotal engager 60' preferably includes a pair of transverse axles 66' extending from a pair of side walls 64'. Preferably, the pair of transverse axles 66' are co-axial with each other and have a common axis 66*a'* that is transverse to an axis 62*a"* of the threaded recess 62*a'*. Additionally, the axle axis 66*a'* is preferably located above the threaded recess axis 62*a"*, and more preferably above threaded recess 62*a'*. Each transverse axle 66' is preferably circular in cross-section. With reference to FIGS. 12-14, each axle 66' is received in a socket 48*b'* in the support member 42'. Preferably, the socket 48*b'* is greater than 180° in circumference but less than 225°. Preferably, the axles 66' are inserted into the sockets 48*b'* and rotatably retained. Preferably, the axles 66' enter the sockets 48*b'* via the socket opening 48*c'*. Preferably, the pair of pivotal engager side walls 64*c'* cooperate with a pair of engager guide surfaces 48*a'* (FIG. 14) to maintain the proper alignment of the threaded recess 62*a'* with the passageway 43'.

Referring to FIGS. 12-16, the pivotal engager 60' includes a lever 70' for pivoting the pivotal engager 60' about the pair of axles 66'. In this preferred embodiment, the pivotal engager 60' from a side view has a generally boot-shape or L-shape appearance as shown in FIGS. 12-14 with the axles 66' substantially at the heel portion of the boot-shape. The support member 42' includes a slot 44' through which the lever 70' extends. The pivotal engager 60' preferably includes an arcuate surface 60*a*' adapted to cooperatively engage an arcuate surface 45' of the support member 42' as shown in FIGS. 12 and 13.

Referring to FIGS. 12-14, the pivotal engager 60' preferably includes a spring post 65' adapted to be circumscribed by one end of the spring 80'. The support member 42' preferably includes a receptacle 47' for receiving a second end of the spring 80' as shown in FIGS. 12 and 13.

The assembly of the second preferred embodiment of the fast-acting screw assembly 100' as depicted in FIGS. 9, 10 and 12-16 will now be described. A first end of the spring 80' is positioned onto the spring post 65' of the pivotal engager 60' as shown in FIG. 14. The pivotal engager 60' and spring 80' are inserted into the support member 42' from the bottom of the tree stand 10' (FIG. 10). The lever 70' is inserted into and through the slot 44' in the support member 42' and the pair of engager side walls 64' are cooperatively and slidably received between the pair of engager guide surfaces 48' of the support member 42'. The axles 66' are pressed through the socket openings 48*c*' into rotatable reception within the sockets 48*b*' and the second end of the spring 80' is received in the receptacle 47'. The spring 80' is contained between the receptacle 47' and the spring post 65' of the pivotal engager 60'. It is to be understood that the spring 80' is maintained in slight compression so as to normally cause the pivotal engager 60' to be in the biased position as shown in FIG. 12. In the biased position, the threaded recess 62*a*' of the pivotal engager lower face 62' is substantially axially aligned with the bore portion 43*a*' and the semi-circular inner portion 43*b*' of the bolt passageway 43' for threaded engagement with the bolt 50 upon insertion of the bolt 50 into the passageway 43'. Alternatively or additionally, the spring-biased pivotal engager 60' may assume a slightly further counter-clockwise position in FIG. 12 prior to insertion of the bolt 50 through the passageway 43'.

The bolt 50 is installed by inserting the inner end 56 into the outer circular bore portion 43*a*' and through the bolt passageway 43'. As the bolt 50 is axially inserted in the passageway 43' toward the center of the tree stand 10', the bolt threads 52 come into contact with the threaded recess 62*a*' of the pivotal engager 60' when the pivotal engager 60' is in the biased or normal position. Preferably, the axial force exerted on the bolt 50 exceeds the spring-bias acting on the pivotal engager 60' and causes the pivotal engager 60' to slightly rotate about the axis of the axles 66' in a clockwise direction in FIG. 13, further compressing the spring 80'. Preferably, the amount of centrally-directed, axial force on the bolt 50 required to overcome the spring bias is insubstantial. The position of the pivotal engager 60' during this sliding insertion of the bolt 50 along the threaded recess 62*a*' is referred to as the biased and disengaged position as the bolt threads 52 are not threadedly engaged with the threaded recess 62*a*'. Upon removal of the axial force, the threaded portions of the bolt 50 and the pivotal engager 60' will be permitted to engage each other as a result of the spring bias. This position is referred to as the biased and engaged position. After the bolt 50 has been inserted through the passageway 43', the end cap 58 is securely attached to the bolt inner end 56, preferably via a friction connection.

It is to be understood that the fast-acting screw assembly 100' permits the bolt 50 to be rapidly advanced in the passageway 43' toward the center of the tree stand 10' without rotating the bolt 50. When the axial force is removed, the spring force rotates the pivotal engager 60' in the counter-clockwise direction to the biased and engaged position (FIG. 12) in which the threaded recess 62*a*' of the pivotal engager 60' threadedly mates with the threaded shank 52.

Additionally, it is to be understood that the bolt 50 can be freely inserted in the passageway 43' by manually pulling or "cocking" the lever 70' toward the outer edge of the tree stand 10' to a displaced and disengaged position. In the displaced and disengaged position, the pivotal engager threaded recess 62*a*' is displaced and does not contact the threaded shank 52 as the bolt 50 extends through the passageway 43'. It is to be further understood that in the displaced and disengaged position the bolt 50 can be axially slid within the passageway 43' in either direction.

Preferably, the pivotal engager 60' of the fast-acting screw assembly 100 is spring-biased to the biased and engaged position. As described above, an axial force acting on the bolt 50 from the handle portion 54 towards the inner end 56 will overcome the spring force and disengage the mating threads and allow the bolt 50 to travel towards the center of the tree stand 10. However, an axial force acting on the bolt 50 in the opposite direction (i.e., from the inner end 56 towards the handle portion 54) in the biased and engaged position causes the pivotal engager 60' to slightly rotate and provide even greater threaded frictional engagement between the bolt 50 and the pivotal engager 60'. Thus, the threaded portions 52 and 62*a*' remain firmly mated and the bolt 50 is prevented from moving in an outward direction (i.e., away from the center of the tree stand 10)—unless the bolt 50 is rotated. It is to be understood that in the biased and engaged position, the bolt 50 can move axially in the passageway 43 in either direction by rotation.

During the procedure of placing and securing a tree in the tree stand 10', as with the previous embodiment, the bolts 50 are preferably initially retracted such that each bolt inner end 56 and end cap 58 is adjacent the respective upright support member 42'. The cut end of the tree trunk is positioned, preferably fairly centrally, within the water basin 20. The tree is mounted to the tree stand 10' by placing any lower tree limbs between the upright support members 42', if necessary, and the trunk crown 26' is embedded within the trunk end. With the tree in its desired upright position, the bolts 50 are pushed inwardly until contacting or adjacent the tree trunk T. Final tightening of the bolts 50 is accomplished by rotating the bolts 50, typically only one revolution or less. The bolts 50 should be rotated at least a quarter turn to a half turn to ensure a secure friction fit between the components.

When the bolts 50 are tightened securely against the tree, the lever 70' is prevented from being moved to the displaced and disengaged position because of the threaded frictional engagement of the bolt 50 and the pivotal engager 60'. As best illustrated in FIG. 16, it is to be understood that as the bolt 50 is tightened and resisted by the tree trunk, the force exerted on the bolt by the tree causes the pivotal engager 60' to rotate or pivot slightly about the center of the axle 66' to further increase the threaded frictional engagement of the bolt 50 and the pivotal engager 60'. Preferably, the forces transmitted to the pivotal engager 60' are primarily resisted by the socket 48*b*' (FIGS. 12-14). The fast-acting screw assembly 100' can be disengaged from the tightened position by rotating the bolt (in the direction to loosen) approximately a quarter turn at which time the lever 70' is free to be moved to the displaced and disengaged position.

In the preferred embodiment, a plurality of pins 28 extend upright from the bottom wall 22 as shown in FIG. 9. Preferably, the pins 28 are formed during the molding of the tree stand 10. The location of the pins 28 is preferably outside the circle formed by the centrally-facing surfaces 42*b*' of the upright support members 42' so as not to interfere with the tree trunk T upon installation. Preferably, the pins 28 secure the bolts 50 to the basin bottom wall 22 during shipping. As shown in FIG. 9, the bolts 50 preferably lie flat on the bottom wall 22 and the end caps 58 frictionally engage the pins 28 to maintain the bolts in this position during shipping. To release the bolts 50 from the shipped position, each bolt 50 is manually moved or pried, preferably by raising the inner end 56 of the bolt 50, which disengages the end cap 58 from the pin 28.

In the preferred embodiments of the present invention, the support member passageways 43, 43' have an axis 43*c'* (FIG. 9) intersecting a central axis 10*a'* (FIG. 9) of the tree stand 10, 10'. Preferably, the plurality of support member passageways axes all intersect at a common point on the central axis 10*a'* as shown in FIG. 9.

The foregoing disclosure and description of the invention are illustrative and explanatory thereof, and various changes in the size, shape and materials, as well as the details of the illustrated operation and construction may be made without departing from the spirit and scope of the invention.

I claim:

1. A tree stand assembly comprising:

a container defining a basin, the container having a central axis;

a plurality of securement assemblies attached to said container, said plurality of securement assemblies spaced from each other and defining a space within said container for receiving the base of a tree trunk, each said securement assembly including a support member having a passageway therethrough in an upper portion thereof and a fast-acting screw assembly;

each said fast-acting screw assembly comprising:

a bolt extending through said passageway and having a longitudinal axis configured to intersect the central axis of the container, said bolt having a shank with threads; and an engager coupled to said support member, said engager having a recess with threads, said recess threads designed to threadedly engage said shank threads;

said engager having a biased position allowing said bolt to slide in a first axial direction in said passageway while preventing said bolt from sliding in an opposing second axial direction.

2. The tree stand assembly of claim 1, wherein each said support member passageway has an axis intersecting a central axis of said container.

3. The tree stand assembly of claim 1, wherein each said engager is spring-biased.

4. The tree stand assembly of claim 1, wherein said biased position of each said engager has an engaged position in which said recess threads are threadedly engaged with said shank threads and a disengaged position in which said recess threads are not threadedly engaged with said shank threads.

5. The tree stand assembly of claim 4, wherein said engager further includes a displaced position in which said bolt is allowed to slide in said passageway in said first and second axial directions.

6. The tree stand assembly of claim 5, wherein said engager slides between said biased and displaced positions.

7. The tree stand assembly of claim 6, wherein said engager comprises a wedge-shape member.

8. The tree stand assembly of claim 5, wherein said engager pivots between said biased and displaced positions.

9. The tree stand assembly of claim 8, wherein said engager includes a lever for manipulating said engager between said biased and displaced positions.

10. The tree stand assembly of claim 8, wherein said engager pivots about a pivot axis that is transverse to said threaded recess.

11. The tree stand assembly of claim 10, wherein said pivot axis is above said threaded recess.

12. The tree stand assembly of claim 10, wherein said threaded recess has an axis and said pivot axis is above said threaded recess axis.

13. The tree stand assembly of claim 1, wherein said plurality of securement assemblies comprises a first pair of securement assemblies in opposing relationship to each other.

14. The tree stand assembly of claim 13, wherein said fast acting screw assemblies of said first pair of securement assemblies are in opposing relationship to each other.

15. A tree stand assembly comprising:

a container defining a basin;

a plurality of securement assemblies coupled to said container, said plurality of securement assemblies spaced from each other and defining a space within said container for receiving the base of a tree trunk, each said securement assembly including a support member having a passageway therethrough in an upper portion thereof and a fast-acting screw assembly;

each said fast-acting screw assembly comprising:

a bolt extending through said passageway and into the defining space within said container, said bolt having a shank with threads; and an engager coupled to said support member, said engager having a recess with threads, said recess threads designed to threadedly engage said shank threads;

said engager having an engaged position in which said recess threads threadedly engage said shank threads and a displaced position in which said recess threads do not contact said shank threads in said passageway, wherein said engager is configured to move between said engaged position and said displaced position while said bolt extends through said passageway and into the defining space within said container.

16. The tree stand assembly of claim 15, wherein in said displaced position said bolt is allowed to slide in said passageway in both axial directions.

17. The tree stand assembly of claim 15, wherein each said engager is normally spring-biased to said engaged position.

18. The tree stand assembly of claim 17, wherein each said engager includes sliding movement between said engaged and displaced positions.

19. The tree stand assembly of claim 18, wherein each said engager comprises a wedge-shaped member.

20. The tree stand assembly of claim 17, wherein each said engager includes a pivoting movement between said engaged and displaced positions.

21. The tree stand assembly of claim 15, wherein said plurality of securement assemblies are uniformly spaced from each other and each said support member passageway has an axis intersecting a central axis of said container at a common point.

22. The tree stand assembly of claim 15, wherein each said engager includes a biased position allowing said bolt to slide in a first axial direction in said passageway while preventing said bolt from sliding in an opposing second axial direction.

23. A method for quickly securing a trunk of a tree within a tree stand, the tree stand of the type including a container and a plurality of threaded assemblies spatially arranged and designed to secure the tree trunk to the container in a desired position, each threaded assembly including a movable engager and a bolt extending through a passageway, the bolt including a plurality of threads, the method comprising the steps of:

freely positioning the tree trunk in the container between the plurality of spatially arranged threaded assemblies;

axially sliding the bolts within the passageways in the direction of the tree trunk such that at least some of the threads pass the movable engager;

threadedly advancing the bolts within the passageways into secure engagement with the tree trunk.

24. The method of claim 23, wherein said sliding step includes sliding the bolts until the bolts contact the tree trunk.

25. The method of claim 24, wherein said threadedly advancing step comprises rotating the bolts.

26. The method of claim 25, further comprising the step of contacting the tree trunk bottom with a portion of the container.

* * * * *